United States Patent [19]

Vinazzer et al.

[11] Patent Number: 4,572,540

[45] Date of Patent: Feb. 25, 1986

[54] SAFETY SKI BINDING

[75] Inventors: Edith Vinazzer, Vienna; Johann Sollak, Baden, both of Austria

[73] Assignee: TMC Corporation, Baar, Switzerland

[21] Appl. No.: 451,915

[22] Filed: Dec. 21, 1982

[30] Foreign Application Priority Data

Dec. 23, 1981 [AT] Austria ..... 5526/81

[51] Int. Cl.[4] ..... A63C 9/08

[52] U.S. Cl. ..... 280/612; 280/631

[58] Field of Search ..... 280/612, 611, 631, 632

[56] References Cited

U.S. PATENT DOCUMENTS

| | | | |
|---|---|---|---|
| 3,776,567 | 12/1973 | Shimizu | 280/631 |
| 3,940,156 | 7/1976 | Marker | 280/612 |
| 4,159,124 | 6/1979 | Salomon | 280/612 |

FOREIGN PATENT DOCUMENTS

| | | | |
|---|---|---|---|
| 300634 | 10/1972 | Austria | 280/612 |
| 324903 | 9/1975 | Austria | 280/612 |
| 2757800 | 7/1978 | Fed. Rep. of Germany | 280/612 |

*Primary Examiner*—David M. Mitchell

*Attorney, Agent, or Firm*—Flynn, Thiel, Boutell & Tanis

[57] ABSTRACT

A safety ski binding for releasably securing a ski boot on a ski includes a bearing block adapted to be supported on the ski, a stepping member supported on the bearing block for pivotal movement about a horizontal axis which extends transversely of the ski, and a sole holder adapted to engage a sole of the ski boot and supported on the sole holder for generally vertical movement relative thereto. A spring urges the sole holder downwardly relative to the support member, and an electrically controlled locking mechanism is adapted to releasably maintain the stepping member in a first position. An electrical switch of the locking mechanism closes when the sole holder has moved upwardly a predetermined distance relative to the stepping member and thereby causes the locking mechanism to release the stepping member for pivotal movement about the horizontal axis.

12 Claims, 7 Drawing Figures

SAFETY SKI BINDING

FIELD OF THE INVENTION

The invention relates to a safety ski binding and, more particularly, to a heel holder which has a bearing block which can be fixed against movement with respect to a ski and a sole holder which can be pivoted together with a stepping member about a swivel axle which extends transversely with respect to the longitudinal direction of the ski and is supported on the bearing block, which sole holder is held in the downhill skiing position by means of a locking mechanism which can be operated by an electromagnet, electromotor or the like provided in a circuit, and which releases the sole holder upon an overload to permit it to swivel into the open position.

BACKGROUND OF THE INVENTION

A safety ski binding of the above-mentioned type is described for example in Austrian Pat. No. 324 903. In this conventional construction (see in particular FIG. 1), a spring biased lock member is hinged swingably on the bearing block and grips over a bolt which is also supported on the bearing block. The lock member transmits the forces which act upwardly on the sole holder onto a piezoelectrical element which is provided on the lock member, through which an electrical voltage is created. At a suitably high voltage, an electromotor is switched on, which releases the lock member from the bolt, so that the sole holder can swing upwardly and can release the ski boot. A disadvantage of this conventional design consists in the lock member which engages the bolt permitting the sole holder to have only a small vertical elasticity, so that this binding can hardly absorb impacts elastically and an uncomfortable, hard skiing feeling is created.

This disadvantage can be found also in other electrically or electromagnetically operable safety ski bindings, as for example the safety ski binding which is described in German OS No. 27 57 800.

Therefore a basic purpose of the invention is to design a safety ski binding of the above-mentioned type so that it has a sufficient vertical elasticity.

SUMMARY OF THE INVENTION

This purpose is inventively attained by the sole holder being supported for vertical movement against the force of a spring and, after a preferably adjustable amount of upward movement, closing the circuit, the further spring being supported at one end on the sole holder and at the other end on an adjustable abutment which is directly or indirectly supported on the bearing block, and wherein in the downhill skiing position the stepping member is supported directly on a lock member or is connected to the lock member by a lever linkage.

Through the inventive measures, it is assumed that the sole holder has available in the vertical direction a sufficient elasticity, whereby after exceeding the path of elasticity the sole holder itself effects a closing of the circuit which is provided with the electromagnet, the electromotor or the like, and a quick and safe release of the lock which blocks movement of the stepping member exists.

A further characteristic of the invention includes the stepping member being pivotally supported on the swivel axle and carrying a guide pin, along which the sole holder can be moved vertically by means of a guide part, on which guide part is supported the other end of the spring, the adjustable abutment of which is held in a spring cage which is open at one end. In this manner, a coupling of the sole holder with the stepping member for a common swivelling of the two parts is assured. The arrangement of a spring cage assures a space saving arrangement of the spring and favors a compact design of the heel holder.

A further thought of the invention consists in the spring cage being arranged a clearance distance from the guide part of the sole holder, whereby at the end regions of the spring cage and guide part which face one another there are arranged respective, preferably resilient contacts which are in alignment with one another and form a switch $S_1$ which is provided for closing the circuit having the electromagnet. The clearance distance determines the amount of elasticity which is available for the sole holder. By arranging the two contacts on the sole holder and the spring cage, a closing of the switch is assured as soon as the amount of elasticity which is available is exceeded.

A particularly simple support of the spring cage on the bearing block exists inventively when the spring cage has two bearing pins which each extend through a slotted hole of the sole holder which extends longitudinally of the spring cage and are each guided in a respective groove on the inner surface of each side wall of the bearing block, which grooves extend concentrically with respect to the swivel axle of the stepping member and the sole holder. This construction permits on the one hand the sole holder to carry out vertical movement relative to the spring cage and on the other hand permit the spring cage to carry out a pivoting movement together with the sole holder about the swivel axle.

A further characteristic of the invention relates to the stepping member being constructed as a two-arm lever, one arm of which is constructed as a stepping spur and the other arm of which is constructed as a locking arm, on which is secured the guide pin and the free end of which cooperates with the free end of the lock member, whereby the effective length of the locking arm is substantially larger, preferably 3 to 5 times larger, than the distance, projected on the longitudinal axis of the ski, between the region of engagement of the boot sole and sole holder and the swivel axle. In this manner, the force which is transmitted from the sole holder through the stepping member onto the lock member, is substantially less than the force which acts on the sole holder, through which the release of the stepping member by the lock is made substantially easier.

It is also advantageous if, according to a further characteristic of the invention, the locking arm of the stepping member has at its free end, starting out from its region which is supported on the lock, a rounded portion which extends across its entire width, and if the lock member has in its region which is engaged by the locking arm of the stepping member an inclined surface which extends across the entire width and forms an acute angle, preferably greater than 45°, with respect to the upper side of the ski. When stepping into the binding, the rounded portion of the stepping member engages the lock member in the area of its inclined surface and presses same, against the force of the spring which biases it, away from the stepping member until the closed position, in which position the lock member can extend under the stepping member, is reached.

Furthermore, it can be provided inventively that the lock member has at its free end a rotatably supported roller, on which is supported the locking arm of the stepping member. This measure contributes substantially to the reduction of friction which occurs between the lock and the stepping member. Also in this case, it is assured when stepping into the binding that the stepping member engages the lock member and moves it into the locked position.

A further characteristic of the invention includes the releasable locking between the stepping member and the lock member being formed by two two-arm lever linkages, one arm of each being hinged to the free end of the locking arm of the stepping member and the other arm being hinged to the bearing block, and by the free end of the lock member engaging a connecting rod which connects the two linkages and serves as a common pivot axis for the lever arms thereof. Through this construction, a release of the locking of the lock member and stepping member is assured without an occurrence of frictional forces worth mentioning. Upon stepping into the binding, there occurs an expansion of the lever linkages, which are bent during a release.

In order to assure a satisfactory pulling away of the lock member by the electromagnet, it is provided inventively that the arms of the two linkages which are hinged to the bearing block are connected with one another by means of a pin which is slidably guided in slots which are constructed in the side walls of the bearing block and are arranged concentrically with respect to the swivel axle.

An undesired bending of the two linkages in the downhill skiing position is avoided inventively if either the lever arms hinged to the stepping member or the lever arms hinged to the pin are each provided with a stop which engages the associated lever arm.

BRIEF DESCRIPTION OF THE DRAWINGS

Further characteristics, advantages and details of the invention will be described in greater detail hereinafter in connection with the drawing, which illustrates several exemplary embodiments.

In the drawing.

DETAILED DESCRIPTION

Figure 1:
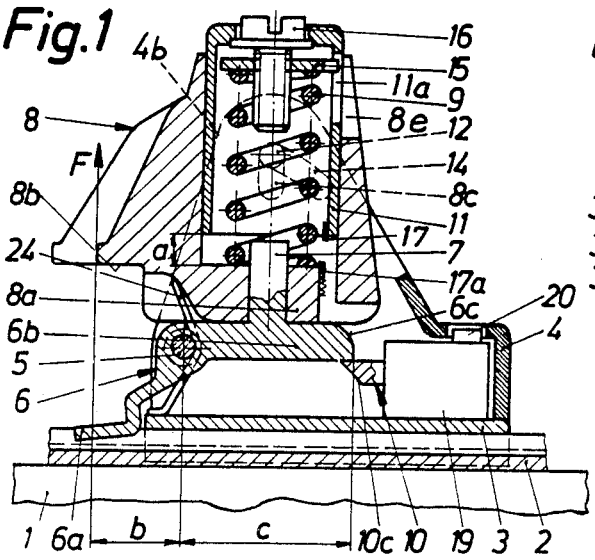
FIG. 1 is a cross-sectional side view in the downhill skiing position of a heel holder embodying the invention.

As can be seen from FIG. 1, a conventional guide rail 2 is secured on a ski 1 by means of screws (not illustrated). A conventional base plate 3 is guided movably in the longitudinal direction of the ski 1 on the guide rail 2 and can be releasably locked against movement with respect to the guide rail 2 in a conventional, not illustrated manner for adjusting the binding to different length ski boots. A bearing block 4 is secured on the base plate 3, and has two spaced side walls 4*b* which project from the base plate 3 upwardly and carry at their lower regions a swivel axle 5 which extends parallel to the upper side of the ski and transversely to the longitudinal axis of the ski. A stepping member 6 which is constructed as a two-arm lever is pivotally supported on the swivel axle 5, one arm of which stepping member is constructed as a stepping spur 6*a* for supporting the ski boot sole and the other arm of which extends approximately parallel to the upper side of the ski and is constructed as a locking arm 6*b*. The locking arm 6*b* has, at its end which is remote from the swivel axle 5, and starting out from its flat underside, a rounded portion 6*c* which extends across its entire width.

The locking arm 6*b* of the stepping member 6 carries furthermore on its upper side a guide pin 7 which extends perpendicular to the upper side of the ski and on which guide pin a guide part 8*a* of a sole holder 8 is supported for vertical movement by means of a cylindrical opening therein having a diameter approximately equal to that of the pin 7. The sole holder 8 carries above the stepping spur 6*a* of the stepping member 6 a downholding member 8*b* which, in the downhill skiing position of the heel holder, grips over the sole of a ski boot (not illustrated). In the downhill skiing position of the heel holder, the sole holder 8 is supported by means of its guide part 8*a*, under the action of a spring 9, against the upper side of the locking arm 6*b* of the stepping member 6. The lower end of the spring 9 is supported on the guide part 8*a* of the sole holder 8. Starting out from the guide part 8*a* the spring 9 projects into a preferably cylindrical spring cage 11, which is open at its lower end and is positioned, in the downhill skiing position, perpendicular to the upper side of the ski. The other end of the spring 9 is supported on an abutment 15 which is arranged on the threaded portion of an adjusting screw 16, the head of which extends through and is rotatably supported by the closed upper end of the spring cage 11. The initial tension of the spring 9 can be adjusted by rotating the adjusting screw 16, and the adjusted spring force can be read by viewing the abutment 15 through a window 11*a* of the spring cage 11 and an aligned window 8*e* of the sole holder 8, adjacent which window 8*e* is provided a graduated scale which is not a part of the invention and therefore not identified in detail.

Two bearing pins 12 are provided on opposite sides of the spring cage, and each extend through a respective slotted hole 8*c* in the sole holder and engage a respective groove 14, which grooves 14 are constructed in the inner surfaces of the respective side walls 4*b* of the bearing block 4. The two slotted holes 8*c* in the sole holder 8 extend approximately perpendicular to the upper side of the ski. The grooves 14 extend concentrically with respect to the swivel axle 5. In the downhill skiing or closed position of the heel holder (FIG. 1), each bearing pin 12 is located at the upper end of its associated slotted hole 8*c* and at the upper end of its associated groove 14, which end is nearest the downholding member 8*b*.

Between the upper side of the guide part 8*a* of the sole holder 8 and the open lower end of the spring cage 11 a clearance a is provided. Two preferably resilient or resiliently supported contacts 17 and 17*a* are respectively secured on the ends of spring cage 11 and guide part 8*a*, which ends face one another. The two contacts 17 and 17*a* are arranged in alignment with one another and project slightly beyond the structural parts on which they are arranged in a direction toward the other. The contacts 17 and 17*a* are manufactured in an advantageous manner of a corrosion resistant material, for example of gold. The contacts 17 and 17*a* form a switch $S_1$ (see FIG. 2*b*) which in the downhill skiing position of the heel holder is open and which is arranged in a circuit for supplying current to an electromagnet 18. A battery 23 delivers the current which is necessary for energizing the electromagnet 18. The just described structural parts are located in a housing 19 which is secured on the base plate 3 or on the bearing block 4.

Figure 2:
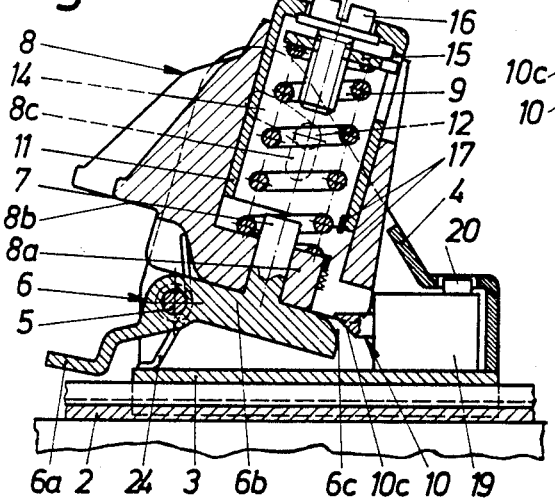
FIG. 2 is a cross-sectional side view of the heel holder of FIG. 1 in the open position.
Figure 2A:
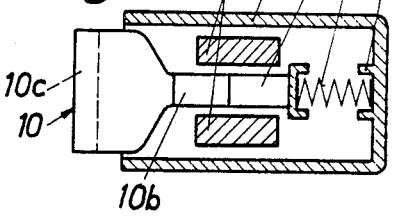
FIG. 2*a* is a sectional top view of the mechanism controlling a lock member, which parts are components of the heel holder of FIG. 1.
Figure 2B:
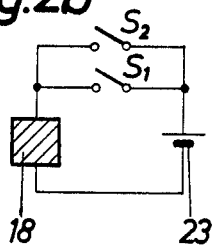
FIG. 2*b* illustrates schematically a circuit arrangement for the control mechanism of the heel holder of FIG. 1, FIG. 3 and 3*a* illustrate a further exemplary embodiment of a lock member, FIG. 3 being a sectional top view and FIG. 3*a* a sectional side view.

In the circuit of FIG. 2*b*, the electromagnet 18, the battery 23 and the switch $S_1$ are connected in series, and a further switch $S_2$ is connected in parallel with the switch $S_1$. Thus, electromagnet 18 will be energized when either or both of the switches $S_1$ and $S_2$ is closed.

A lock member 10 is supported for movement in the longitudinal direction of the ski 1 in the housing 19 and has a control rod 10*a* which extends through the inside of the electromagnet 18. The electromagnet 18 and lock member 10 could, for example, be the coil and piston of a solenoid. The portion of the lock member 10 which projects from the housing 19 is platelike and is provided at its end with an inclined surface 10*c* which extends across the entire width of the lock member 10, and which extends at an acute angle, preferably larger than 45°, with respect to the upper side of the ski 1 in the closed position. In the downhill skiing or closed position of the heel holder, the end of the lock member 10 grips under the locking arm 6*b* of the stepping member 6 (FIG. 1) and prevents swivelling of the sole holder 8. On section 10*b* of the control rod 10*a* is made of a magnetized material and projects, in the locked position of the heel holder and thus in the downhill skiing position, slightly into the inside of the electromagnet 18 (FIG. 2*a*). One end of a spring 21 is supported on the end of the lock member 10 remote from the surface 10*c* and its other end is supported on an abutment 21 which is fixedly connected to the housing 19. The spring 21 presses the lock member 10 toward the stepping member 6.

The switch $S_2$ (see FIG. 2*b*) includes a key 20 and is mounted on the upper side of the housing 19, which switch $S_2$ is connected in parallel with the switch $S_2$ and can be closed manually or by means of a ski pole tip. For the electrically conducting connection of the switches $S_1$ and $S_2$ with the battery 23 and the electromagnet 18, cables which are not illustrated are provided, which are located inside of the sole holder 8 or of the housing 19 and are thus protected against environmental influences.

If the downholding member 8*b* is now urged upwardly, for example by the ski boot sole (not illustrated) and due to a fall of the skier, then the sole holder 8 moves upwardly along the guide pin 7 against the force of the spring 9 by means of its guide part 8*a*. The slotted holes 8*c* in the sole holder 8 permit the upward movement of the sole holder 8 relative to the spring cage 11 which is held by cooperation of the bearing pins 12 and the bearing block 4. If the path of elasticity which is determined by the clearance a between the spring cage 11 and the guide part 8*a* is covered by the sole holder 8, the contacts 17 engage one another, so that the circuit including the battery 23 and electromagnet 18 is closed and the electromagnet 18 is energized and pulls the lock member 10 away from the stepping member 6, permitting the sole holder 8 to pivot together with the spring cage 11 and the stepping member 6 about the swivel axle 5, assisted by an opening spring 24. The spring 24 is arranged on the swivel axle 5, has one end supported on the base plate 3 and the other end supported on the sole holder 8, and is a torsion spring. The bearing pins 12, which are guided in the grooves 14 of the bearing block 4, permit the pivoting movement of the spring cage 11 about the swivel axle 5. As soon as the ski boot is released, a downward return of the sole holder 8 along the guide pin 7 is effected by the action of the spring 9. The engagement of the two contacts 17 and 17*a* is interrupted and the lock member 10 returns to its original position under the action of the spring 21 which biases the lock member, whereby its inclined surface 10*c* is now above the rounded portion 6*c* of the locking arm 6*b* of the stepping member 6 (see FIG. 2).

To again insert the ski boot into the heel holder, its sole is placed onto the stepping spur 6*a* of the stepping member 6 and the stepping member 6 is pivoted about the swivel axle 5 into the closed position together with the sole holder 8 and the spring cage 11. During each swivelling movement, the locking arm 6*b* of the stepping member 6 engages by means of its rounded portion 6*c* the inclined surface 10*c* of the lock member 10 and thus presses the lock member 10, against the force of the spring 21, into the housing 19 until the downhill skiing position is again reached, in which position the locking arm 16 of the stepping member 6 is supported on the lock member 10, so that again a swiveling of the sole holder 8 is prevented.

A voluntary opening of the heel holder occurs by manually pressing on the key 20, which causes the switch $S_2$ to be closed and the electromagnet 18 to pull the lock member 10 away from the stepping member 6. However, it is also possible to provide on the lock member 10 a member which is to be operated manually, which extends through a recess in the housing 19 and by means of which the lock member 10 can be manually moved away from the stepping member 6.

A region of the downholding member 8*b* of the sole holder 8 is urged upwardly by the ski boot sole during an automatic release caused by an upwardly directed force which is characterized in FIG. 1 with the arrow F. As one can easily recognize from this figure, the distance b between this region of engagement with the boot sole and the swivel axle 5 is smaller than the distance c between the swivel axle 5 and the locking region at the end of the stepping member 6. Through this, the force which is transmitted from the downholding member 8*b* through the stepping member 6 and onto the lock member 10 is also substantially smaller than the force F which acts on the downholding member 8*b*, through which the release of the stepping member 6 by the lock member 10 is made easier. An easier release is also facilitated if the surfaces of the locking arm 6*b* on the stepping member 6 and the lock member 10, which engage each other are coated with a friction reducing material.

Figure 3:
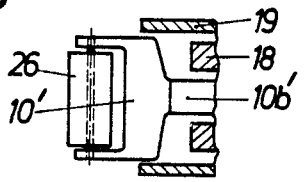
Figure 3A:
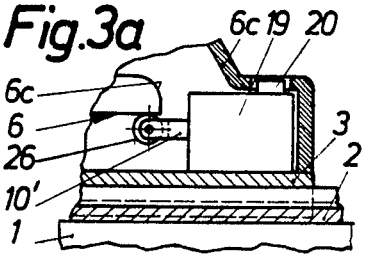

To reduce the friction which occurs between the lock member and the stepping member 6 during a release, it is also possible, as is illustrated in FIGS. 3 and 3*a*, to support a roller 26 at the end of the lock member 10'. The end of the lock member 10', which end is associated with the stepping member, is provided here with two spaced holding shoulders, between which the roller 26 is supported rotatably. In the downhill skiing position of the heel holder, the locking arm 6b of the stepping member 6 is supported on the roller 26 of the lock 10 and projects past the axis of rotation of the roller 26 approximately 2 to 3 mm, through which an undesired release is avoided. As soon as the electromagnet 18 has attracted the lock member 10' for this distance, a release of the ski boot occurs through the swivelling movement about the swivel axle 5 of the stepping member 6, which rolls along the roller 26, without any need for the electromagnet 18 to continue to be supplied with current which drains the battery 23. By providing the roller 26, stepping into the heel holder is also made easier.

Figure 4:
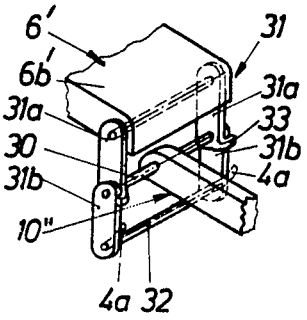
FIG. 4 is a perspective view of a further exemplary embodiment of a lock mechanism.

In the exemplary embodiment which is illustrated in FIG. 4, the end of the lock member 10'' which projects from the housing 19 is pivotally supported on a connecting rod 30 for two toggle joint lever linkages 31. Each linkage 31 includes two lever arms 31a, 31b of equal length which are pivotally connected by means of the connecting rod 30. The free ends of the two lever arms 31a are each pivotally supported on respective sides of the locking arm 6'b of the stepping member 6', and the free ends of the lever arms 31b are each pivotally supported by means of a pin or bolt 32 on the bearing block 4. The ends of bolt 32 extend into slots 4a in the bearing block 4, which slots are arranged concentrically with respect to the swivel axle 5 and are indicated diagrammatically in FIG. 4 with broken lines.

In the downhill skiing position of the heel holder, the two linkages 31 are maintained in the condition shown in FIG. 4 by the spring biased lock member 10'' and are prevented from moving beyond this position by means of a respective stop 33 arranged on each lever arm 31a. The design of the rest of the structural parts of the heel holder, which parts are not illustrated in this figure, corresponds with the design of the heel holder illustrated in FIG. 1.

Also in this exemplary embodiment, after closing of the switch $S_1$ through an upward movement of the sole holder 8 against the force of the spring 9, the electromagnet 18 is energized, which attracts the lock member 10'' and causes the two linkages 31 to be bent and permits the sole holder 8 to pivot upwardly about the swivel axle 5 to release the ski boot. During this bending movement, the bolt 32 slides upwardly in the slot 4a of the bearing block 4. During stepping into the binding there occurs an extension of the two linkages 31, assisted by the spring 21 which biases the lock member 10''.

The invention is not limited to the illustrated exemplary embodiments. Further modifications or variations of the disclosed apparatus, including the rearrangement of parts, are possible without leaving the scope of protection. Thus, it is conceivable to provide the lock member with a wedge-shaped locking projection which engages a congruently constructed locking groove in the locking arm of the stepping member. Also, it would be possible to provide the locking arm of the stepping member with a roller which is supportable on the lock member. Furthermore, either the contact which is arranged resiliently on the spring cage or the contact which is arranged resiliently on the guide part of the sole holder could be supported by notches which are constructed at various vertical positions on the spring cage or on the guide part, through which an adjustment or reduction of the amount of elasticity of the sole holder, that is, the distance the sole holder can move without a release and thereafter return to its initial position, is possible. Also, it is conceivable to provide for operating the lock member an electromagnet which drives a drive pinion, which in turn engages a tooth system provided on the lock member.

The embodiments of the invention in which an exclusive property or privilege is claimed are defined as follows:

1. In a safety ski binding, including a bearing block which can be secured against movement with respect to a ski and a sole holder which is pivotal together with a stepping member about a swivel axle provided on the bearing block, the swivel axle extending transversely with respect to the longitudinal direction of the ski, wherein the sole holder can be releasably held by means of a lock mechanism in a downhill skiing position, the lock mechanism being operable by an electromechanical actuating device which is provided in a circuit and the lock mechanism releasing the sole holder upon an overload to permit it to swing into an open position, the improvement comprising means supporting the sole holder for movement against the force of a spring in a vertical direction relative to the stepping member, switch means for closing the circuit after a predetermined amount of upward movement of the sole holder relative to the stepping member, and means for supporting an abutment on the bearing block in a manner permitting the abutment to be adjusted vertically relative to the bearing block, the spring being supported at a first end on the sole holder and at a second end on the adjustable abutment, wherein the lock mechanism includes a lock member movable between a locking position and a retracted position by the electromechanical actuating device, and wherein the lock mechanism includes means for releasably holding the stepping member in the downhill skiing position when the lock member is in its locking position and for permitting pivotal movement of the stepping member to a release position when the lock member is moved to its retracted position.

2. The safety ski binding according to claim 1, wherein the stepping member is pivotally supported on the swivel axle, wherein the means supporting the sole holder for movement relative to the stepping member includes a guide pin on which the sole holder is supported for movement in the vertical direction by means of a guide part, on which guide part the first end of the spring is supported, and wherein the means adjustably supporting the abutment includes the adjustable abutment being movably supported in a spring cage which is supported on the bearing block and which is open at one end.

3. The safety ski binding according to claim 2, wherein the spring cage is spaced by a clearance distance from the guide part of the sole holder, and wherein said switch means includes two spaced contacts which are respectively provided on portions of the spring cage and guide part which face one another, which are in alignment with one another and which engage each other when the sole holder has moved upwardly the predetermined amount relative to the stepping member.

4. The safety ski binding according to claim 2, wherein the bearing block has two spaced side walls, and wherein the spring cage has two bearing pins which each extend through a respective slotted hole provided in the sole holder so as to extend longitudinally of the spring case, and which each engage a groove provided in an inner surface of a respective said side wall of the bearing block and are slidably guided in said grooves, the grooves each extending concentrically with respect to the swivel axle of the stepping member and the sole holder.

5.

The safety ski binding according to claim 2, wherein the stepping member is a two-arm lever, a first arm of which is a stepping spur and a second arm of which is a locking arm on which the guide pin is secured, wherein the means responsive to the lock member is releasably holding the stepping member in the downhill skiing position includes the locking arm of the stepping member having a free end portion which cooperates with a free end of the lock member, and wherein the effective length of the locking arm is substantially greater than the distance, in a direction parallel to the longitudinal axis of the ski, between the swivel axle and the region of engagement of a boot sole and the sole holder.

6. The safety ski binding according to claim 5, wherein the locking arm of the stepping member has on its free end, starting out from a portion thereof which can engage the lock member, a rounded portion which extends across its entire width, and wherein the lock member, starting from a portion thereof which can engage the locking arm of the stepping member, has an inclined surface which extends across its entire width and in the downhill skiing position of the binding is arranged at an acute angle with respect to the upper side of the ski.

7. The safety ski binding according to claim 1, wherein the means responsive to the lock member for releasably holding the stepping member in the downhill skiing position includes the lock member having at a free end thereof a rotatably supported roller, and includes the stepping member having a locking arm which the roller can engage.

8. The safety ski binding according to claim 1, wherein the means responsive to the lock member for releasably holding the stepping member in the downhill skiing position includes two linkages which each have first and second levers, each said first lever having a first end which is pivotally supported on a free end of a locking arm provided on the stepping member and each said second lever having a first end which is pivotally supported on the bearing block, and includes a free end of the lock member having supported thereon a connecting rod which is an axle pivotally connecting the first and second levers of each of the lever linkages at a second end of each said lever remote from the first end thereof.

9. The safety ski binding according to claim 8, wherein the first ends of the second levers are connected by means of a pin having its ends guided in slots which are constructed in side walls of the bearing block and arranged concentrically to the swivel axle.

10. The safety ski binding according to claim 8, wherein one of the levers of each said linkage has a stop which can engage the other lever thereof to limit relative rotation of the two levers of the linkage.

11. The safety ski binding according to claim 1, wherein the means responsive to the lock member for releasably holding the stepping member in the downhill skiing position includes the lock member having a portion which directly slidably engages a portion of the stepping member when the stepping member is in the downhill skiing position and the lock member is in its locking position.

12. A safety ski binding, comprising a bearing block adapted to be supported on a ski, a support member supported on said bearing block for pivotal movement about a horizontal transverse axis between a downhill skiing position and a release position, a sole holder supported on said support member for reciprocal movement relative thereto in directions which are substantially vertical in said downhill skiing position, resilient means for yieldably urging said sole holder downwardly relative to said support member, means for limiting downward movement of said sole holder relative to said support member past an initial position, switch means responsive to a predetermined amount of upward movement of said sole holder away from said initial position relative to said support member for producing an electric signal, and electrically actuable locking means for releasably holding said support member and said sole holder in said downhill skiing position, said electrically actuable locking means being responsive to said switch means and releasing in response to said electrical signal from said switch means so as to permit pivotal movement of said support member and said sole holder about said axis from said downhill skiing position to said release position.

* * * * *